United States Patent [19]

Alheid et al.

[11] 4,245,582

[45] Jan. 20, 1981

[54] ADJUSTABLE ROD HOLDER FOR METERING ROD COATERS

[75] Inventors: Robert J. Alheid, Beloit; Robert O. Budd, Janesville, both of Wis.

[73] Assignee: Beloit Corporation, Beloit, Wis.

[21] Appl. No.: 9,236

[22] Filed: Feb. 2, 1979

[51] Int. Cl.[3] ..... B05C 11/02

[52] U.S. Cl. ..... 118/119

[58] Field of Search ..... 118/116, 117, 118, 123, 118/126, 262, 119

[56] References Cited

U.S. PATENT DOCUMENTS 3,817,208 6/1974 Barnscheidt et al. ..... 118/119

*Primary Examiner*—Bernard D. Pianalto

*Attorney, Agent, or Firm*—D. J. Veneman; M. L. Gill; G. A. Mathews

[57] ABSTRACT

A holder for rotatably mounting the metering rod in a rod-type web coating apparatus, such as used to coat paper, is made of a rigid but yieldably deformable material, such as a plastic. The holder includes a plurality of longitudinally extending conduits for carrying water to lubricate the rotating rod and removing coating particles which are carried by the rod from the web surface and into the rod cavity. The holder has a surface opposite the rod cavity for receiving a uniformly applied load along the longitudinal length of the rod holder for aligning the rod surface and/or applying a uniform nipping load between the rod and surface of the web being coated. A second surface also extends longitudinally for the length of the holder along a lip portion which protrudes from one side of the cylindrical rod cavity. The second surface on the lip portion is adapted to receive a second uniformly applied load to urge the rod cavity to assume a smaller effective diameter to maintain the desired sealing engagement with the rod.

3 Claims, 6 Drawing Figures

ADJUSTABLE ROD HOLDER FOR METERING ROD COATERS

BACKGROUND OF THE INVENTION

This invention relates to web coating apparatus such as is used, for example, to coat paper for magazines. More specifically, this invention relates to a new type of holder to mount the rotating metering rod in the so-called"rod coater" type coating apparatus.

Rod coaters are well known in the papermaking industry as exemplified by U.S. Pat. Nos. 3,143,438; 3,179,083 and 3,683,851. Typical rod holders used in rod coating apparatus are exemplified by U.S. Pat. Nos. 3,683,851 and 3,701,335.

In existing rod coater equipment, as shown in the above cited patent apparatus, the rod is inserted into the rod holder longitudinally from one end which necessitates a bench assembly since the rod is inserted with a press or interference fit. The rod holder with inserted rod then in turn is mounted longitudinally in the coating apparatus which requires the coater to be "down", or in an inoperative status.

In addition, existing types of rod holders have no capability for having the size of the rod cavity adjusted to accommodate wear during the course of operation. In all rod coaters, the relatively abrasive coating materials containing various types of oxides and carbonates, wear away the surface of the rod holder cavity bearing against the rotating rod. Eventually, the gap between the rod and rod holder becomes so large that lubricating water escapes to deleteriously affect the coating applied to the web. Further, localized differences in the wear of the rod holder caused by variations in the distribution of the coating material which is picked up by the rod and carried into the cavity cause uneven wear which results in more water escaping in those localized places to delute the coating and thereby cause streaking in the web.

In order to extend the life of prior rod holders in rod coaters, the cylindrical cavity, or bore, formed in the rod holder was made smaller than the diameter of the rod, such as, for example, a 0.003 inch interference fit, so that the rod holder could accommodate additional wear before the gap between the rod and rod holder become too large to prevent an excessive amount of water to escape and mark the web being coated. Perhaps because of the interference fits, rods on existing coaterscommonly last only from ten days to two weeks before their chrome plating wears off. In addition, the wear of the cylindrical cavity in the rod holder of prior rod coaters becomes excessive (i.e. lubricating water begins to leak) typically after about two to three weeks of operation at which time the coater must be shut down to replace the rod holder. Naturally, this is very costly both from a standpoint of coater down time as well as the cost of replacing rods and rod holders.

Besides the short life of existing types of rod hodlers, their operation requires high initial torque to turn the rod due to the interference fit with the rod holder. As the rod holder cavity wears and becomes larger, the amount of lubricating water carried on the rod's surface and transferred to the coating increases and this may vary so much from the initial amount of water carried on the rod as to noticeably affect the appearance of the coating compared with its appearance when the rod holder is new.

SUMMARY OF THE INVENTION

This invention mitigates the deficiencies and problems associated with prior art rod coaters and even obviates some of the problems in their structure and operation. Operating uniformity and adjustability is provided by the utilization of two pressure tubes. The first pressure tube is positioned between a backing bar on a bracket mounted between the pivoted arm assemblies and a loading surface on the rod holder opposite the rod cavity. The first pressure tube operates to profile the nip line of the rod as desired. It can also be used to load the rod against the paper web on the backing roll.

The rod holder of this invention includes a lip extending substantially radially from one side of the rod cavity and longitudinally along the rod holder. An air inflatable, expandable second pressure tube coextends with the lip portion of the holder longitudinally of the holder body and parallel to the rod cavity. The second pressure tube operates to engage the lip and exert a uniform force along the length of the lip which causes that side of the rod cavity to uniformly deform and bear against the rod. Effectively, movement of the lip changes the diameter of the rod cavity to adjust for wear. This selectively variable deformation of the rod cavity is facilitated by making the rod holder of a plastic material, such as high density polyethylene.

Thus, as the rod holder cavity becomes larger with wear, the air pressure in the second pressure tube is gradually increased to move the lip and tighten the fit between the rotating rod and cavity so that the fit remains very much the same and the lubricating water carried on the rod surface is correspondingly uniform. This results in uniform metering of the coating which is very desirable.

The lip portion of the rod holder also permits the rod cavity to be enlarged, or opened, slightly so that the rod can be removed and a new rod installed from the front instead of the ends. The ability to adjust the size of the rod cavity opening permits rods to be changed without removing the rod holder from the machine as well as permitting longer life of both rod and rod holder. Rod holder life is increased from about 2–3 weeks on prior rod holders to an expected 3 months with this adjustable rod holder, although life will naturally vary according to operating conditions and with different materials.

Accordingly, it is an object of this invention to provide an improved rod holder for a metering rod on a coating apparatus wherein the rod holder cavity is adjustable in size to accommodate wear.

Another object of the invention is to provide a rod holder wherein the rod can be removed and installed from the front without forcing or deforming the lips.

Still another object is to provide a rod holder which is capable of adjusting the pressure with which it grips the rotating rod and thereby regulate the amount of lubricating water carried on the rod into the coating material.

Yet another object is to provide a rod holder which has an extended usable life greater than about three weeks.

A feature of this rod holder is the utilization of two pressurized air tubes to align or profile the rod and adjust the effective diameter of the rod cavity.

These and other objects, features and advantages of the invention will become readily apparent to those skilled in the art when the attached drawings of the preferred embodiment are viewed in conjunction with the following description of the preferred embodiment.

DESCRIPTION OF THE PREFERRED EMBODIMENT

Figure 1:
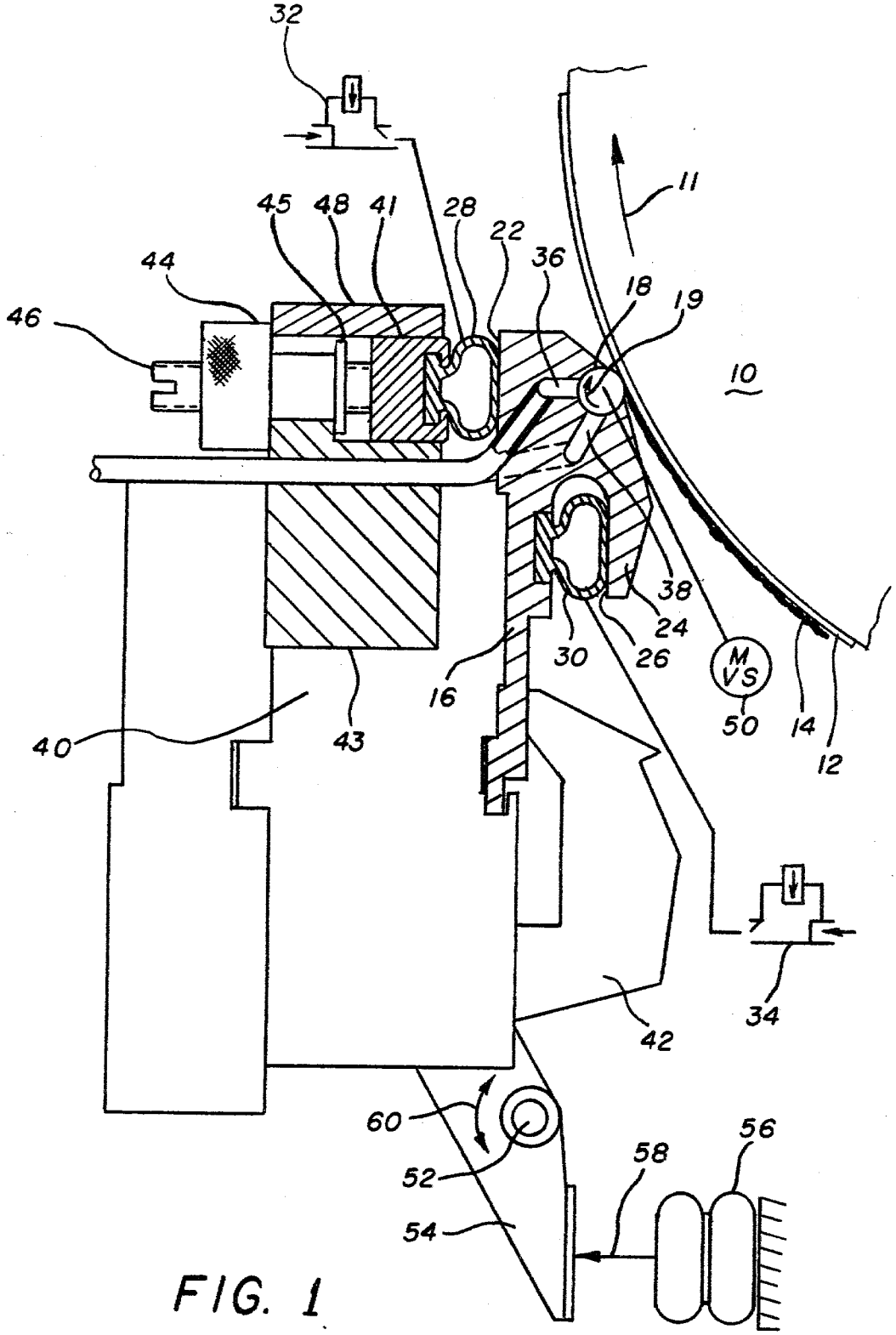
FIG. 1 is a side elevational view, partially in section, of the rod holder assembly shown in operating position against the coater backing roll.
Figure 3:
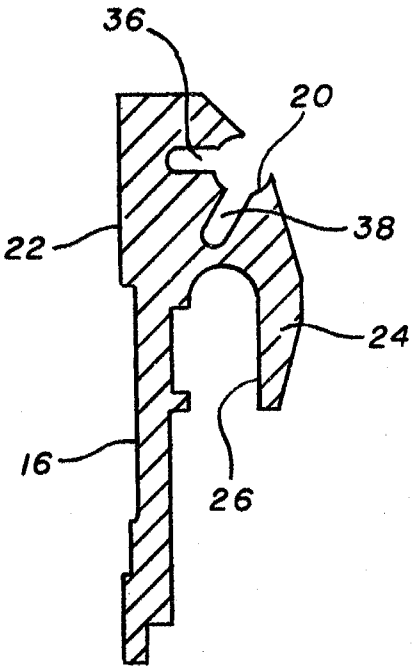
FIGS. 3, 3A, B and C are cross sectional views of the rod holder and illustrate how the rod cavity is adjusted for wear.

As shown in FIG. 1, a coater backing roll 10 is rotating in direction of arrow 11 while supporting a paper web 12 on which a film of coating 14 has been deposited by coating apparatus which is not shown. A metering rod 18 is rotatably mounted in a cylindrical cavity, or bore, 20 extending longitudinally in a rod holder 16 and is positioned against the paper web on the backing roll with the axes of rotation of the rod and backing roll being parallel. A drive motor 50 is operably linked to the rod to rotate the rod in the direction opposite to that of the backing roll as indicated by directional arrow 19.

The rod holder is mounted on a bar 40 with a clamp 42 between a pair of arm assemblies 54, one on either side of the coater. The arm assemblies are pivotally mounted in the coater framework to pivot about an axis 52 against and away from the backing roll in the direction of two headed arrow 60. The arm assembly 54 on either side of the coating apparatus is engaged by an air spring 56 which provides force in the direction of arrow 58 against each arm assembly 54 to move the rod into and out of engagement of the paper web against the backing roll.

On the rod holder 16, at a location behind the rod cavity, a load surface 22 is formed against which the first pressure tube 28 is positioned. The first pressure tube is mounted in a plurality of abutting, axially extending segments of a backing bar 41, each of which segments is about 6 inches long. Each backing bar segment has an adjustment screw 46 extending rearwardly thereof through the back side of an adaptor 43 mounted on the bar 40. Each adjustment screw 46 extends through a corresponding adjustment nut 44, each of which rests in a slot, open at the top, in the adaptor 43. Holding the backing bars 41 and the knurled adjustment nut 44 in place is a clamp 48.

A first air supply source 32 is connected to the first pressure tube 28, and a second air supply source 34 is connected to a second pressure tube 30 which will be described in more detail later.

Figure 2:
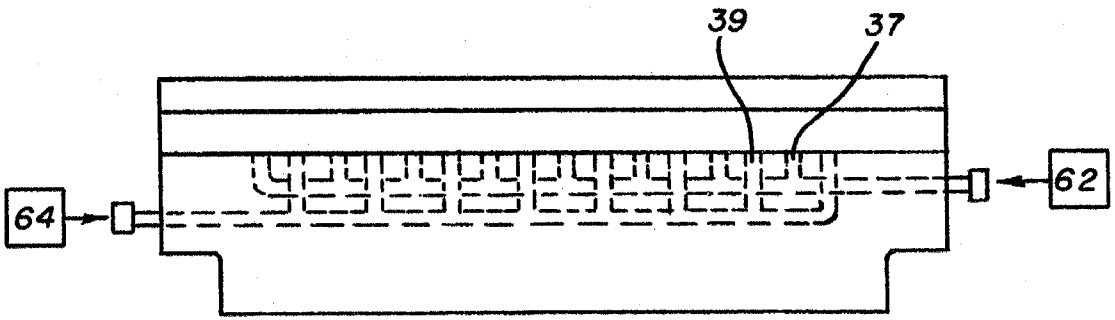
FIG. 2 is a front view of the rod holder.

As shown more clearly in FIG. 2, a pair of conduits 36, 38 extend longitudinally along the cavity 20 in the rod holder. A pressurized water source 62 is connected to one conduit 36 at one end of the rod holder while a second source of pressurized water 64 is connected to conduit 38 on the opposite end of the rod holder. Conduits 36, 38 are fluidly linked with bore 20 by a plurality of spaced passages 37, 39, respectively. The flow of water through the conduit and passages thus operate to provide cross flow to promote removal of the coating material uniformly along the length of the rod. The water also lubricates the rod.

In operation, a pair of air springs 56, one operating against the end of arm assembly 54 on either side of the coating apparatus, are actuated to pivot the rod holder apparatus towards the paper web 12 supported on the backing roll 10. A drive motor 50 rotates the rod within the rod holder in a direction indicated by arrow 19 which is opposite to the direction 11 of the paper being carried on the backing roll. The speed with which rod 18 turns is variable and controlled by the machine operator. Usually, the rod rotational speed varies from about 60 rpm to about 120 rpm, depending on other factors, such as backing roll speed and coating composition, as will be explained shortly. Normally, a rather heavy amount of coating 14 (i.e. about 10 lbs/1000 $ft^2$) is applied to the paper web downstream of the location where rod 18 nips the web on the backing roll. This rod nip pressure typically varies from about 8 pli to about 18 pli and can be provided in either of two ways. The most common, and preferred, way is by means of the air springs 56 operating against the extensions 54 of the arm assemblies on either side of the coating apparatus. The rod nip pressure against the backing roll is then dependent on the air pressure in the air springs 56. However, if desired, the air springs 56 can be used to rotate the whole rod assembly about the pivot axis 52 against stops on the coating apparatus framework (not shown) so that rod 18 just barely touches the web surface on which the coating is to be metered. There is little, or no, nip load. Then, the first pressure tube 28 is pressurized to provide a uniform force against the loading surface 22 along the back side of the rod holder 16 to urge rod 18 into nipping engagement with the web at the desired nip load.

Regardless of the manner used to load rod 18 against the traveling web, the metering action of rod counter rotating against the coating carried on the traveling web reduces the coating weight to about 2 lbs/1000 $ft^2$ of web area.

It is very important that the coating applied to the web be applied uniformly over the entire web area. Ideally, of course, this would mean that the horizontal nip on the cylindrical rod surface be perfectly straight as it extends longitudinally in the cross machine direction. However, due to various irregularities in the machinery and web forming process, the web itself almost invariably is not of a uniform profile, or caliper, in the cross machine direction. Quite simply stated, this means that somewhere along the width of the web, there will be a bulge or depression in the web of perhaps several ten thousandths, or even thousandths, of an inch variation in caliper. In order to coat such a web as uniformly as possible, it is desirable to profile the nip line of contact of the rod to match, as closely as possible, the contour of the web in the cross machine direction. This is accomplished by providing a segmented backing bar 41 against which the first pressure tube 28 bears to provide the nip loading force to the metering rod 18. Backing bar 41 is made up of a plurality of segments, each of which is about 6 inches long, as desired, and which are disposed in end abutting relationship for the entire longitudinal operating length of pressure tube 28.

In the center of each segment of backing bar 41, a threaded adjustment screw 46 is mounted to extend out of the back of adaptor 43. Each adjustment screw is mounted through a threaded adjustment nut 44 which is knurled. By turning the adjustment nut 44 on the appropriate segment of the backing bar 41, the corresponding portion of the pressure tube 28, which is mounted in a longitudinally extending groove in the forward side of each segment, is moved slightly forward or backward, as desired, from the load surface 22 on the back side of the rod holder so that the rod surface at that location is urged to conform to the profile of the paper web at that location on the backing roll to operate to meter the coating to provide an equal thickness of coating along the entire web width. Construction of the adjustment nut 44 and adapter 43 is such that the adjustment nut 44 is captured in a slot in adapter 43. Thus when adjustment nut 44 is turned, either forward or backward movement of the adjustment screw 46 is produced. Those adjustment nuts 44 that are not turned hold their respective adjustment screws stationary. This arrangement allows for selective adjustment of backing bar segments.

As the rod rotates in the rod holder cavity, the cavity begins to wear away and enlarge under the abrasive action of the coating material which is carried into the interface between the rod and holder cavity. The normally cylindrical bore may become non-cylindrical upon enlargement. In prior types of rod holders, which have cylindrical rod cavities of a fixed diameter, it has been found that when the wear on the rod and rod holder creates a gap of 0.002 inch or more, the quantity of water carried by the rotating rod from the lubricating slot becomes sufficiently large to dilute the coating to an extent which deleteriously marks the web. Typically, this occurs after about 10 days to 3 weeks of operation. Since the rods in prior types of coaters must be installed from the end of the holder with an interference fit to increase operating life, the coater had to be shut down and the rod holder removed to install a new rod.

In the apparatus of this invention, the rod 18 and its cylindrical rod cavity 20 are designed to be mounted with substantially a normal press fit. As an example, the rod would have a chrome plated surface with a finish dimension of 0.378/0.377 inch diameter. The rod cavity would have a finish diameter of 0.377/0.378 inch.

Figure 3C:
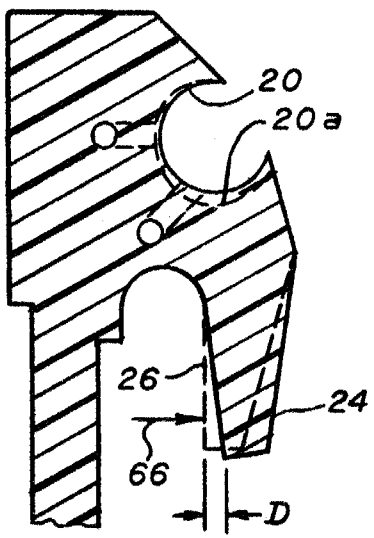
Figure 3B:
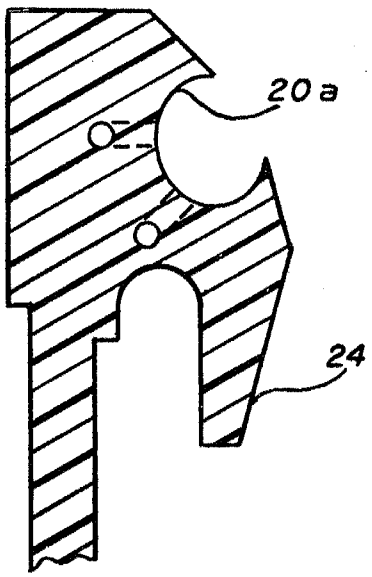
Figure 3A:
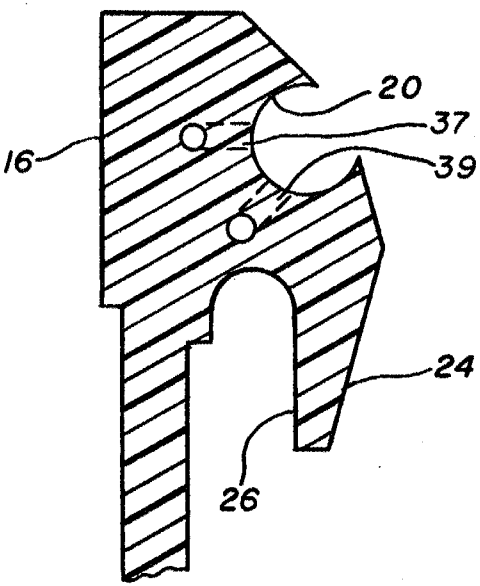

As the cylindrical cavity surface wears away during operation, the side of the cavity, or bore wall, from which the lip portion 24 of the rod holder extends is designed to turn or close inwardly towards the axis of the rotating rod for a distance of about 0.015 inch, although this distance is really a function of many factors, such as the size of the rod holder, the rod cavity, the length of lip portion 24 and the material used in its construction and can therefore be made greater or smaller as desired. As shown in FIGS. 3A, 3B and 3C, this movement of essentially one side of the cavity wall is accomplished by the lip 24 being pivotally turned by the uniform force against the second surface 26 by increasing the pressure within second pressure tube 30. In FIG. 3B, the cavity has enlarged to a greater size as indicated by numeral 20*a*. The enlarged cavity 20*a* may no longer be cylindrical. As shown in FIG. 3C, the force designated by arrow 66, which is supplied by inflating second pressure tube 30, has turned lip portion 24 a distance "D" which has caused the associated part of cavity 20*a* to turn inwardly to effectively decrease the diameter of cavity 20*a*. The locations of lip portion 24, before pressure is applied, and enlarged cavity 20*a* are shown in dashed lines in FIG. 3C. Depending on the air pressure supplied to pressure tube 30 by the second source 34 of air supply, such as an air compressor, the size of cavity 20*a* can be reduced slightly or effectively returned to the size of original cavity 20. This allows the sealing pressure of the rod holder cavity wall to be maintained against the rod surface as desired and, concomitantly, it maintains the desired fit between the rod and rod holder cavity. Movement of the lip portion does not necessarily return the bore to its original, cylindrical shape, but this isn't necessary. Maintaining the fit between rod and rod holder as constant as possible and preventing excessive water leakage around the rod is the goal. By doing this, the torque required by drive motor 50 to turn the rod will also remain nearly constant and the rod will operate more uniformly to smooth the coating. A uniform fit also enhances the quality of the coating process because the film of water carried by the rotating rod from the lubricating slots 36, 38 onto the coating, as the rod meters the coating to the desired weight, is also controlled thereby to ensure that it does not become so great to cause streaking or otherwise lessen the appearance of the coating.

The rod speed is increased or decreased within a range of, for example, about 60 to about 120 rpm, to prevent a pattern from forming on the metered coating on the web due to film splitting. Film splitting is a phenomenon which occurs when liquid coating material is present between two surfaces which are moving in different directions. A typical example occurs when a web on which coating has been deposited is passed between a pair of nipped rolls. Both the web and either or both of the roll surfaces contact the coating. The web and the roll surface diverge on the off-going side of the nip. The coating material is literally split into two films, one of which stays on the web while the other remains on the roll surface. As the coating splits into two films, the interface consists of a multitude of thread-like portions of liquid coating material, each of which has one end contacting one of the diverging surfaces. These portions are sometimes referred to as "stickies" in the trade. When the thread-like portions eventually break, the material that returns to each surface causes some marking on the film formed on the web which is undesirable because it blemishes the just previously coated surface.

The rod speed is adjusted by the machine operator as a function of backing roll speed, coating weight and type as well as other factors, such as humidity or temperature which might affect the coating process. The rod rotating in a direction counter to the direction of the coated paper web operates to lay the "stickies" of the split film back down onto the web so that no pattern or blemish is imparted to the web which would otherwise be caused when the split film carried by the rod is pulled away from the split film which remains on the traveling web.

The rod is chrome plated to provide a smooth surface that won't contaminate the coating material. When the chrome coating on the rod has worn away, or when the rod holder cavity has become so large that the second pressure tube can no longer provide the force necessary to maintain the desired fit due to the increased distance the lip must turn, rod 18 can be removed from the face of the rod holder by depressing second pressure tube 30 and simply pushing lip 24 inwardly to allow the rod to be popped out of the front of the rod holder and a new rod installed. In the case where the chrome plating of the rod has worn away, a new rod of the same size is installed. In the case where the cavity has enlarged beyond its desired size, a larger diameter rod may be installed. In either case, the rod can be replaced without removing the rod holder from the coater, thus saving a considerable amount of time.

While the preferred embodiment of this rod coating apparatus has been set forth in detail, it is contemplated that various changes in the apparatus and substitutions made in the materials for the components parts can be made without departing from the spirit and scope of the appended claims. For example, while polyethylene is preferred material for the rod holder, other materials, such as polypropylene, vinyl and Teflon may be used with satisfactory results. The essential aspect is that the material forming the bore wall in the rod holder be made of a stiff, resiliently deformable material so that it can hold the rotating rod and yet be capable of being selectively moved to effectively change the bore diameter responsive to movement of the lip portion. Obviously, the most natural, and preferred, way of accomplishing this is to make the entire rod holder of a suitable plastic material, such as polyethylene. However it is contemplated that not all of the rod holder per se need to be made of the same material in order for the rod holder to function according to the principles set forth. For example the lip portion of the rod holder could be made of metal and the rod holder could still operate to change the size of the cavity, as desired.

Also, the tolerances for the rod diameter and rod holder cavity opening as well as the degree of permissible wear in the rod holder before replacement is desired are intended to be illustrative rather than representing limits on their relationships.

What is claimed is:

1. A rod holder for use in a web coating apparatus wherein a rod is positioned against a traveling web on a backing roll to meter coating thereon, said rod holder including:

a longitudinally extending cavity for receiving a cylindrical rod for rotating therein, said cavity having its bore wall made of a stiff, resiliently deformable material;

a first pressure surface for receiving and transmitting a correspondingly coextensive first force to the cavity for insuring a uniform nip force between the rod surface and the web on the backing roll;

a lip portion coextending with the cavity longitudinally of the rod holder along one side thereof, said lip portion having a second pressure surface for receiving a second force independent of said first force for urging the lip portion to move its associated side of the cavity bore wall inwardly to reduce the bore of the cavity to adjust the fit of the rod within the cavity, as desired, to compensate for wear of the cavity bore wall as the rod is rotated therein.

2. Apparatus for metering coating on a web traveling on a backing roll comprising, in combination:

a rod holder having (a) a cavity extending longitudinally therein and having its bore wall made of a stiff, resiliently deformable material, (b) a first pressure surface coextending with the cavity in opposed relationship thereto, (c) a lip portion coextending with the cavity longitudinally of the rod holder along one side thereof, said lip portion having a second pressure surface;

a metering rod rotatably mounted in the cavity;

a backing bar mounted in spaced adjacency with the first pressure surface and coextending therewith;

a first pressure means operatively disposed between the first pressure surface and the backing bar for providing a uniform first force along the cavity to urge the rod into the desired position against the web;

a second pressure means interposed between the second pressure surface and the rod holder for providing a uniform second force against the lip portion independent of the first force to move the lip portion and thereby move the associated side of the cavity bore wall inwardly against the rod to thereby adjust the fit between the rod and cavity bore, as desired, to compensate for wear of the cavity bore wall as the rod is rotated therein.

3. The apparatus as set forth in claim 2, wherein:

the backing bar is segmented into a plurality of segments arrayed in abutting relationship substantially coextensive with the first pressure surface; and further including means for adjustably positioning each segment of the backing bar relative to the first pressure surface whereby the corresponding opposed location along the cavity bore wall is adjustable to profile the metering bar surface to accommodate localized variations in web caliper and effect uniform metering of the coating material.

* * * * *